United States Patent [19]

Mineo et al.

[11] 4,049,763

[45] Sept. 20, 1977

[54] PROCESS FOR PRODUCING A HIGHLY ORIENTED POLYESTER UNDRAWN YARN

[75] Inventors: Masatoshi Mineo; Ken-ichiro Oka; Kiyoshi Nakagawa; Hiyoshi Matsuda; Shigeo Ohno; Yasuo Takagi, all of Mishima, Japan

[73] Assignee: Toray Industries, Inc., Tokyo, Japan

[21] Appl. No.: 595,344

[22] Filed: July 14, 1975

[30] Foreign Application Priority Data

July 23, 1974 Japan ..... 49-83777

[51] Int. Cl.[2] ..... D01D 5/12

[52] U.S. Cl. ..... 264/176 F; 264/210 F

[58] Field of Search ..... 264/176 F, 210 F; 57/140, 34

[56] References Cited

U.S. PATENT DOCUMENTS

| | | | |
|---|---|---|---|
| 2,604,689 | 7/1952 | Hebeler | 264/168 |
| 3,771,307 | 11/1973 | Petrille | 57/157 TS |
| 3,772,872 | 11/1973 | Diazza et al. | 57/157 TS |
| 3,946,100 | 3/1976 | Davis et al. | 264/176 F |

FOREIGN PATENT DOCUMENTS

| | | | |
|---|---|---|---|
| 37-7903 | 7/1962 | Japan | 264/210 F |

OTHER PUBLICATIONS

"On the Spin of Polycondensate Fibers at High Speed" by Griehl et al., Faserforschung und Textiltechnik, 9, 1958, pp. 226–231.

*Primary Examiner*—Jay H. Woo
*Attorney, Agent, or Firm*—Miller & Prestia

[57] ABSTRACT

A process for producing a highly oriented polyester undrawn yarn comprising melt-spinning a polyester from a spinneret, solidifying the melt-spun yarn and taking up a solidified yarn at a take-up velocity from 2,500 to 4,500 m/min, wherein the spinning length is set within a specific range in accordance with the take-up velocity, yarn denier and maximum allowable tension of the yarn.

3 Claims, 8 Drawing Figures

PROCESS FOR PRODUCING A HIGHLY ORIENTED POLYESTER UNDRAWN YARN

GENERAL FIELD OF THE INVENTION

The present invention relates to a process for producing a polyester undrawn yarn melt-spun at a high speed and having high orientation. More in particular, the invention relates to a process for producing a highly oriented polyester undrawn yarn by relaxing the high tension of the yarn stemming from high-speed spinning, thereby making it possible for the yarn to be stably wound up into a package as a uniform yarn without being drawn and without being damaged during the spinning process.

DISCUSSION OF THE PRIOR ART

Heretofore, in melt-spinning of synthetic fibers, as shown in FIG. 1, the process has involved cooling and solidifying a yarn 8 spun from a spinneret 1 at a cooling chimney 2 and a yarn duct 3, finishing a solidified yarn by an oiling equipment 4, causing the finished yarn to pass over a first godet roller 5 and a second godet roller 6 in order, and then winding the finished yarn on a spool or package 7. In this process, the length from the spinneret 1 to the first take-up roller, namely, the first godet roller 5 is called the "spinning length," which is generally constituted by a spinning room having many spin blocks heated by a high temperature and a take-up room in an atmosphere controlled to constant humidity and a constant, relatively low temperature. Ordinarily, the respective rooms are separated into upper and lower portions, and the spinning length is within the range from 6 to 8 meters. However, the spinning speed of a conventional spun yarn has been ordinarily 1,200 m/min and problems of take-up conditions including the spinning length have not been particularly troublesome.

Whereas, in recent years, in concomitance with progress of technology for producing synthetic fibers, it has been required to take up yarns at a higher and higher velocity. In the case of polyester, the take-up velocity has been amounting to at least 1,500 m/min. Further, with the development of a draw-texturing method directly connecting the drawing process with the false twisting process, in order to produce a highly oriented undrawn yarn suitable therefor, a yarn spun at a high speed of at least 2,500 m/min has come to be used. Whereas, upon carrying out such high-speed spinning, it has turned out that when the spinning speed is merely mechanically increased under the aforesaid conventional conditions, such drawbacks occur as increase of yarn unevenness, defective shape of the winding package and increase of yarn breakage in the subsequent processing steps.

OBJECT OF THE INVENTION

An object of the present invention is to provide a process for spinning polyester which comprises spinning a highly oriented polyester undrawn yarn having a filament denier of about 2 to 6 at such a high spinning speed as about 2,500 - 4,500 m/min, which is capable of decreasing yarn unevenness and yarn breakage and forming yarn which can be effectively wound into a good package.

Another object of the present invention is to provide a process for spinning polyester which comprises spinning a polyester undrawn yarn having a filament denier of about 2 to 6 at a spinning speed of about 2,500 - 4,500 m/min, enabling a highly oriented undrawn yarn to be produced while yarn is suitable for a draw-texturing process.

DESCRIPTION OF THE PREFERRED EMBODIMENTS

The aforesaid objects of the present invention may be achieved by the following means.

A process is provided for producing a highly oriented polyester undrawn yarn having a filament denier of about 2 to 6 comprising melt-spinning a polyester from a spinneret, solidifying a melt-spun yarn at a take-up velocity from about 2,500 to 4,500 m/min, wherein the spinning length defined as the length from the spinneret to the first take-up roller is established within the range from about $(d + 2)/4$ (meter) to about $(A/1.2)/(\text{Faero}/x)$ (meter) wherein $d$ is the filament denier of the undrawn yarn, $A$ is the tension (gram) of the filament in an elongation range under a constant tension of a stress-strain curve, Faero/$x$ is the rate of increase of yarn tension per meter subsequent to the yarn solidifying point by an air resistance which is calculated by the formula $\text{Faero}/x = 0.229 \times 10^{-4} . D^{0.39} . V^{1.39}$, wherein $D$ is the diameter of a solidified filament (cm) and $V$ is the velocity of the solidified filament (cm/sec).

It has been surprisingly discovered that the increase of yarn tension due to frictional resistance of air caused by dragging, the fractionizing of the melted polymer and the running of a solidified filament at a high speed, all greatly influence the quality of the product.

Heretofore, with reference to air resistance in melt spinning, as mentioned by A. Ziabicki in "Kolloid-Z," 175 (14), (1961) and by Kase and Matsuo in Journal of Japanese Textile Machine Society, 18 (3) (1965), it has been the majority opinion that the air resistance is slight, and that yarn tension due to air resistance may be ignored. However, in the case of high-speed spinning exceeding 2,000 m/min, the increase of tension due to frictional resistance between the yarn and air becomes remarkable, and cannot be ignored.

The spinning tension due to air resistance increases in proportion to the distance the spun yarn runs in air after said spun yarn has solidified. With reference to air resistance acting on yarn running in air, we wish to refer to Hamana in "Chemistry Extra Issue," 39, "Formation of fiber and development of structure," p. 127 (1969).

We have now found that tension caused by air resistance (hereinafter referred to as Faero) acting on one filament of a group of multifilaments in a standard spinning atmosphere may be expressed by the following formula (1).

$$\text{Faero} = 0.229 \times 10^{-4} D^{0.39} V^{1.39} x \text{ (g)}, \quad (1)$$

where $D$ equals the diameter of one solidified filament (cm)

$V$ equals the yarn speed (take-up speed) (cm/sec) of solidified filaments $x$ equals the distance ($m$) from the solidification point (where change of diameter ceases this may be considered a value below the glass transition point) to the first take-up roller.

Figure 1:
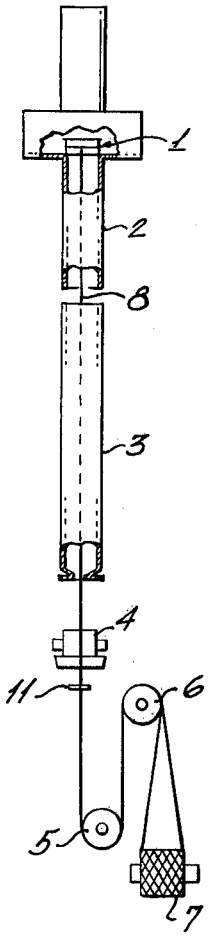
FIG. 1 is a schematic view of a conventional process of taking up a spun yarn.

When spinning is carried out at high speed, the value of Faero according to formula (1) becomes large and in a conventional apparatus the yarn tension at the entrance to the first godet roller 5 in FIG. 1 becomes very high. Further, when the yarn is wound up per se without relaxing the yarn, a package is formed having high internal strain in the filaments. Therefore, a defective package forms and deformation of a bobbin may occur by reason of shrinkage. In order to prevent this, when the speed is gradually decreased from the first godet roller, the second godet roller and the winder in this order to thereby relax the yarn, and to wind up the yarn so as to obtain a good package, it is necessary to wind up the yarn under a tension of about 0.08 - 0.15 g/d to produce a good package. However, when the tension is so set up, the difference between the yarn tension of the exit side and that on the entrance side of the second godet roller and the difference between the yarn tension on the exit side and that on the entrance side of the first godet roller become large, the filaments slip on these rollers, a difference of interfilament tensions is brought about, yarn breakage occurs during winding and the filaments tend to become slack on the package. Further, because the spinning tension per se becomes large due to air resistance, in an extreme case, the yarn is extended to some extent in the axial direction, the interference fringe due to molecular orientation becomes non-uniform, fluctuation of filament diameter is observed, excessive forces act on the yarn during spinning, and yarn unevenness occurs.

Such occurrence of yarn unevenness and defective package formation have not been a problem in conventional low-speed spinning. That is because the yarn velocity V is small in formula (1), the air resistance is low and the yarn tension is sufficiently low. Further, when the spinning velocity is low, because the molecular orientation is low, in order to obtain yarn having an elongation of 25 - 35% which is generally considered suitable for a fabric and for a textured yarn, it is necessary to carry out drawing at a draw ratio from about 3 to 5. In order to obtain a 1.5 - 5 denier drawn yarn, it is necessary that the undrawn yarn should be about (4.5-7.5) - (15 - 25) denier. Accordingly, the denier of each filament during spinning is heavy. On the other hand, when the spinning tension is low, the stretch force per unit denier is small, on account of which no inconvenience has been brought about in conventional low-speed spinning.

Whereas, when spinning is performed at a considerably high speed of 2,500 - 4,500 m/min. for producing a highly oriented undrawn yarn having a filament denier of about 2 to 6 which is said to be suitable for draw-texturing, the aforesaid problem has presented itself for the first time. In this case, the spinning velocity V becomes high in formula (1), and because of this the tension due to air resistance increases. On the other hand, in concomitance with increase of spinning velocity, the molecular orientation of the spun yarn increases rapidly. Accordingly, the draw ratio at which the yarn is drawn or draw-textured for obtaining a filament of, for example, 1.5 - 5 denier is 1.3 - 2 times, which is remarkably small. On account of this the denier of the undrawn yarn is about (2 - 3) - (6.5 - 10) denier, which is quite fine.

Accordingly, the stretch force due to air resistance per unit denier becomes relatively large and sometimes promotes stretching of the yarn, which phenomenon is especially remarkable when the denier of an undrawn yarn is below 6.

Figure 3:
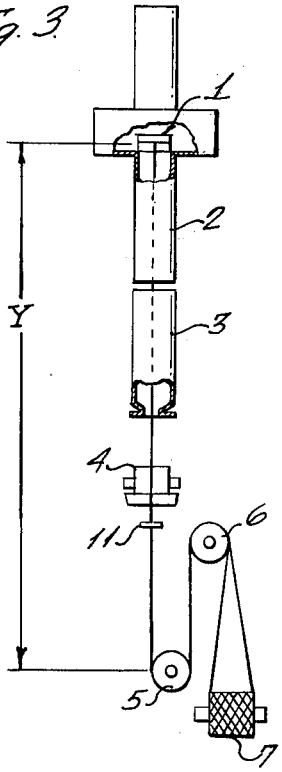
FIG. 3 is a schematic view of a process of taking up a spun yarn having a short spinning length of the present invention.

As a result of conducting studies from various angles for overcoming such drawbacks, we have found that it is most effective to shorten the distance from the spinneret 1 to the first take-up roller 5 in accordance with spinning velocity and denier. As shown in FIG. 3, this is the spinning length Y.

Namely, in formula (1), when $x$ is made small, the Faero vaue becomes small and it is possible to have a small increase of tension due to air resistance. The Faero value is the increased tension after the filament is solidified and until it reaches the first take-up roller. Ways are available for inferring or calculating the spinning tension directly from Faero, as follows:

At first, from formula (1), the increased tension per meter due to air resistance is represented by (Faero/$x$).

Originally, the sum of the strength necessary for pulling and deforming the melted polymer and all other various strengths becomes the spinning tension. It is found that the spinning tension F may be approximately expressed by the following formula toward a spinning length containing a zone in which the spinning velocity is being gradually increased from the spinneret to the solidification point, namely, the so-called deformation zone:

$$F \approx (\text{Faero}/x) \cdot Y \quad (2)$$

In formula (2), $Y$ means the length ($m$) from the spinneret to he first take-up roller, namely, the spinning length. accordingly, $Y$ is expressed by the following formula.

$Y = x +$ (distance from spinneret to solidification point).

It is also known that in order not to deform spun yarn during the spinning process and to yield a uniform undrawn yarn, it is necessary that the yarn tension at the entrance of the first take-up roller 5, namely, the spinning tension F, should be lower than the tension A of the elongation range under the constant tension of the stress-strain curve ($\approx$ range of the necking tension) by at least about 20%, namely, $A/F \geqq 1.2$.

When $A/F \geqq 1.2$, non-uniformity of the resulting undrawn yarn is not apparent and good results are obtained. Moreover, by making $A/F \geqq 1.4$, which is preferable, potential drawbacks may be excluded.

Even though apparent birefringence unevenness is not recognized by observation under a polarization microscope, when A/F is close to 1.2, a great air resistance is applied and latent drawbacks are sometimes imparted to the yarn. In such case, this becomes a cause of filament breakage in the drawing or draw-texturing process.

Figure 2:
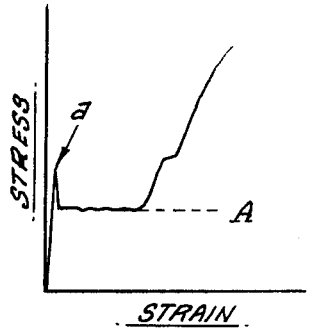
FIG. 2 is a stress-strain curve of a polyester undrawn yarn.

Tension A referred to herein is defined as follows: After leaving an undrawn yarn having a denier of about 2 to 6 obtained by spinning at a spinning velocity of about 2,500 - 4,500 m/min as with a package in an atmosphere at a temperature of 25° C and 65% RH for more than 24 hours, a test sample having a test sample length of 50 mm is subjected to a tensile test at a rate of 400%/min, using an Instron tensile tester. In the resulting stress-strain curve, deformation proceeds accompanied by necking under constant tension, which tension is called tension A in this specification. FIG. 2 is one example of a stress-strain curve of an undrawn yarn so determined.

The reason a uniform undrawn yarn is obtained in the case of $A/F \geqq 1.2$, is not completely clear. However, the following reasons are conceivable:

1. The spinning tension fluctuates with lapse of time, and when $A/F \approx 1$, it is considered that the spinning tension F may possibly exceed the primary yield point (*a* in FIG. 2) of the spun yarn. However, when $A/F \geqq 1.2$, such possibility is only very slight.

2. The primary yield point and the elongation range under constant tension of the stress-strain curve of a polyester undrawn yarn immediately after being spun exists on the low tension side. However, with lapse of time, they shift to the high tension side and are stabilized. Beacuse of this, in order to facilitate measurement, conditioning for more than 24 hours is carried out. However, in the present invention whether a yarn stretches or not in the spinning process becomes a problem prior to aging of the undrawn yarn. Accordingly, it is necessary to estimate the vaue of A sought from the stress-strain curve of the conditioned sample at a rather low point in the actual process. And according to our examinations with reference to aging of polyester undrawn yarn, the change of the stress-strain curve is considered to be about 20%.

And as mentioned above, in order to make the spinning tension F small, so as to make $A/F \geqq 1.2$, preferably $A/F \geqq 1.4$, it suffices to shorten the spinning length. Namely, from formulas (1) and (2), the spinning tension per unit length (*m*) may be expressed by $$(F/Y) \approx (\text{Faero}/x) = 0.229 \times 10^{-4} \cdot D^{0.39} \cdot V^{1.39} \qquad (3)$$

From formula (3), the upper limit of the spinning length ($Y_{ULG}$) may be expressed by $(A/1.2)/(\text{Faero}/x)$. But it is not true that the shorter the spinning length, the better the results. Y has its own lower limit. Namely, it is necessary to cool a spun yarn; generally the spun yarn is cooled to a temperature below the glass transition point and oiled and is thereafter taken up by a take-up roller. For example, if oiling equipment is located between the spinneret and the first take-up roller, at that oiling position, or if there is no oiling equipment, at the position of the first take-up roller, it is necessary to cool the spun yarn to a temperature below the glass transition point, preferably to a temperature below the glass transition point minus about 10° C. Otherwise, when the spun yarn is oiled or taken up by the roller, some defects are imparted to the yarn, bringing about broken filaments or uneven dyeing later. Especially, in the case of a polyester filament, it is desirable that the yarn surface be cooled to about 50° C. From this point of view, the lower limit of the spinning length is determined. As a result of our examination, it has been found that said lower limit of the spinning length ($Y_{LL}$) is constant regardless of the spinning speed and is expressed by $(d + 2)/4$. This lower limit of spinning length has to be considered from the spinneret to the oiling roller, if it is present or to the first take-up roller.

Generally, a regulation guide 11 of thread line, which does not bend the thread line, is used as shown in FIG. 1 or FIG. 3.

Figure 4A:
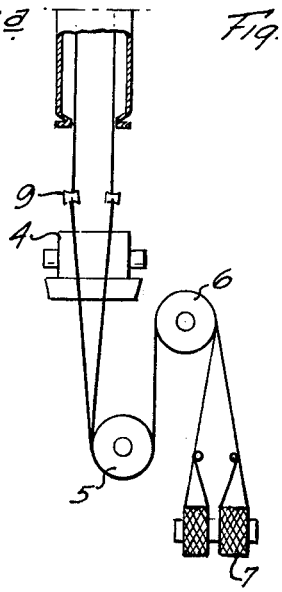
FIG. 4*a* is a schematic view of a process of taking up two yarns on one spool into two packages using guides.
Figure 4B:
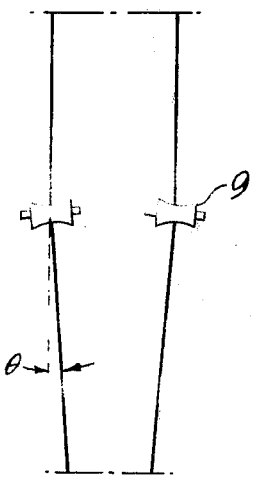
FIG. 4*b* is an enlarged schematic view of the guide portions of FIG. 4*a*.
Figure 5:
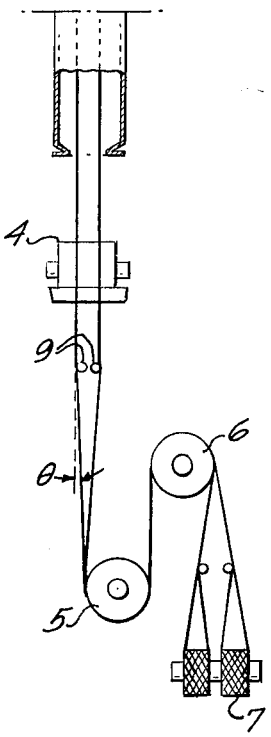
FIG. 5 is a schematic view of another process of taking up two yarns on one spool into two packages using guides.

Upon carrying out high-speed spinning of thin filaments for draw-texturing, it is desirable to simultaneously spin and take up multiple yarns for increasing productivity per position as shown in FIG. 4 to FIG. 6. In such cases, the thread line must be changed using many guides 9, 10 in fron of and behind the godet roller 5. In this case also, when the yarn tension is high, the yarn is damaged by the guides in that proportion, and sometimes, on the contrary, the guides are harmed by the yarn. Especially in the case of high-speed spinning, as mentioned earlier, molecular orientation proceeds and the draw ratio is reduced. Therefore, the undrawn yarn becomes thin, the external force becomes relatively high and the probability that the yarn will undergo deformation increases. Because of that, it is preferable to establish the maximum allowable tension under which it is allowable to change the thread line using guides. As a result of examinations about such maximum tension, it has been found that such tension is below 0.3 g/d. The use of guides herein referred to means making the bending angle $\theta$ of the yarn above 5° by bringing the yarn into contact with guides or guide rollers, not containing the mere use of guides for preventing the departure of the yarn from the ordinary thread line and yarn oscillation.

Figure 6A:
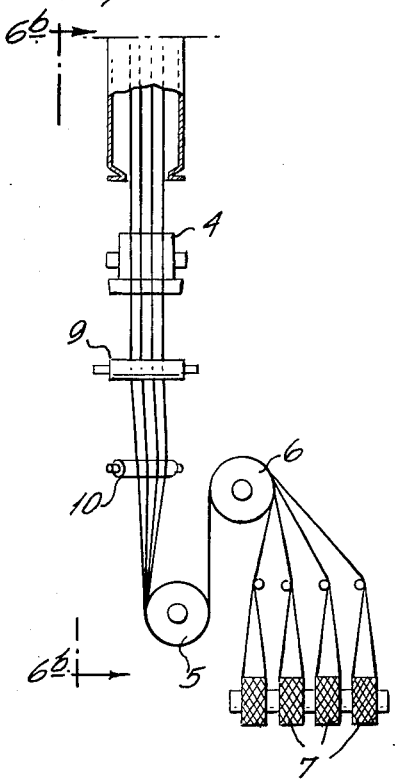
FIG. 6*a* is a schematic view of a process of taking up four yarns on one spool into four packages using guides.
Figure 6B:
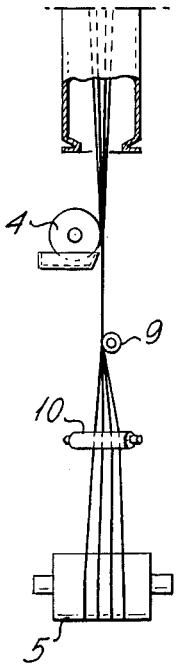
FIG. 6*b* is an enlarged schematic view of FIG. 6*a* in the vicinity of the guides.

The expression "bending angle of the yarn," as herein referred to, refers to the angle $\theta$ between the direction of the yarn before it passes the guide and the direction of the yarn after it passes the guide as shown in FIG. 4*a*, 4*b* and 5. And as shown in FIGS. 6*a* and 6*b*, when the thread line is changed using a plurality of guides 9, 10, a value obtained by adding up the bending angle of the yarn by the respective guides is defined as the bending angle of the yarn.

When the tension per single undrawn yarn is referred to as B (g) when said maximum allowable tension in the case of using guides is established at 0.3 g/d, it is necessary that the spinning tension be $B > F$, namely, $B/F > 1$. It is necessary that the upper limit of the spinning length ($Y_{ULG}$) for realizing this be the lower of either $B/(\text{Faero}/x)$ or $(A/1.2)/(\text{Faero}/x)$.

Namely, when the filament denier of the spun undrawn yarn is relatively thick, the value sought by $B/(\text{Faero}/x)$ is smaller, but when the filament denier is relatively thin and the spinning speed becomes high, the influence of the spinning tension due to air resistance becomes strong and the value of $(A/1.2)/(\text{Faero}/x)$ becomes smaller. Incidentally, it is necessary to make the minimum spinning length ($Y_{LLG}$), $(d + 2)/4$ determined by said cooling conditions.

When the spinning length exceeds the upper limit thereof of $B/(\text{Faero}/x)$ or $(A/1.2)/(\text{Faero}/x)$, for such reason as mentioned above, yarn unevenness is brought about in the spun yarn and the yarn is damaged, and these become causes of yarn breakage or defective package formation.

When the spinning length is less than said lower limit, it is apparently inconvenient from the viewpoint of cooling as mentioned above.

The polyester constituting the polyester undrawn yarn of the present invention is a polyester containing at least about 85 mole % of a polyethylene terephthalate unit as a repeating unit thereof.

The present invention relates to a process for obtaining a polyester undrawn yarn spun at a high speed of about 2,500 – 4,500 m/min, namely, a highly oriented polyester yarn to be drawn or draw-textured in a subsequent process. According to the present invention, it is possible to decrease yarn unevenness. Therefore, it is possible to decrease the number of broken filaments and yarn breakage in subsequent processes and to improve the dye uniformity of the final yarn and to obtain a qualitatively good product therefrom.

Regarding the process for spinning according to the present invention, whether a godet roller is used or not does not matter. The yarn may instead be wound directly on a winder with essentially the same results, and the winder may be considered as corresponding to the first take-up roller.

Hereinafter, the present invention will be explained in detail by reference to examples.

EXAMPLE 1

Polyethylene terephthalate having an intrinsic viscosity of 0.61 was melted at 285° C, extruded from a spinneret having 36 orifices each having a diameter of 0.3 mm at a rate of 40 g/min and taken up at a velocity of 3,000 m/min to obtain an undrawn yarn. Its particulars are shown in the following Table 1.

The spinning length at this time was 3.5 m and an oiling roller was disposed at a distance of 3,0 m from the spinneret. The upper limit of the spinning length sought from (A/1.2)/(Faero/$x$) was 5.1 m and the lower limit of the spinning length sought from $(d + 2)/4$ was 1.4 m.

Table 1

| | |
|---|---|
| Yarn denier (d) | 122 |
| Filament denier (d) | 3.4 |
| Filament diameter (cm) | $1.87 \times 10^{-3}$ |
| Tension in an elongation range under constant tension of the stress-strain curve (g/filament) | 1.7 |
| Maximum spinning tension during spinning (g/filament) | 0.95 |

Using an Uster evenness tester, when said undrawn yarn was subjected to a half inert test at a yarn speed of 25 m/min, the yarn unevenness was 0.35%. When the interference fringe due to molecular orientation of this yarn was observed under a polarization microscope, no unevenness was recognized along the axial direction. Next, when the undrawn yarn was false-twisted while being drawn about 1.7 times, the number of broken filaments was not more than 2 per 10,000 m, and from the resulting false-twisted yarn, very uniform knitted goods were obtained even after dyeing.

COMPARATIVE EXAMPLE 1

Melt spinning was carried out under the same conditions as in Example 1 except that the spinning length was 6.5 m. The maximum spinning tension was 63 g, or 1.8 g per filament.

When this undrawn yarn was false-twisted while yarn was measured by an Uster evenness tester, it was 1.3%. When the undrawn yarn was observed under an interference microscope, an interference fringe was observed as undergoing an irregular change.

When this undrawn yarn was flase-twisted while being drawn about 1.7 times, many filaments broke and occurrence of more than 10 broken filaments per 2,000 m was recognized often.

EXAMPLE 2

Polyethylene terephthalate having an intrinsic viscosity of 0.61 was melted at 285° C and extruded from a spinneret having 36 orifices each having a diameter of 0.3 mm at a rate of 40 g/min. The spun yarn was taken up at a velocity of 2,500 m/min by both first and second godet rollers and at a velocity of 2,450 m/min by a winder to obtain an undrawn yarn the particulars of which are shown in Table 2.

The spinning length in this case was 3.0 m, and an oiling roller was disposed at a distance of 2.6 m from the spinneret.

The upper limit of the spinning length sought from (A/1.2)/(Faero/$x$) was 6.7 m and the lower limit of the spinning length sought from $(d + 2)/4$ was 1.5 m.

Table 2

| | |
|---|---|
| Yarn denier (d) | 144 |
| Filament denier (d) | 4 |
| Filament diameter (cm) | $2.0 \times 10^{-3}$ |
| Tension in an elongation range under the constant tension of the stress-strain curve (g/filament) | 1.7 – 1.8 |
| Maximum yarn tension during spinning (g/filament) | 0.66 |

When said undrawn yarn was subjected to a half inert test at a yarn speed of 25 m/min using an Uster evenness tester, the yarn unevenness was 0.30% and when said undrawn yarn was observed under an interference microscope, the yarn was very uniform. When this undrawn yarn was false-twisted while being drawn about 2 times, the number of broken filaments was not more than 1 per 10,000 m.

EXAMPLE 3

Using an apparatus as shown in FIG. 5, two yarns were melt-spun under the same conditions as in Example 2 and the two yarns were bent by about 10° by guide bars respectively made by sintering alumina disposed below an oiling roller, and taken up. The tension ahead of the guide bar was 23 g and the tension behind the guide bar was 25 g, which was not particularly great.

The undrawn yarn obtained was uniform and no trouble occurred especially during spinning.

When 500 kg of this undrawn yarn was drawn by hot rollers at a speed of 600 m/min and wound up by 1 kg pirns, the percentage of perfectly formed packages was 98.2% without filament breakage.

COMPARATIVE EXAMPLE 2

Melt spinning was carried out under the same conditions as in Example 3 except that the spinning length was changed to 6.5 m. The tension ahead of the guide bars was 51 g and the tension behind the guide bars was 58 g, which was considerably increased from 51 g. When the undrawn yarn obtained was measured by an Uster evenness tester, the thickness unevenness was 0.40%, which was not large. However, when said undrawn yarn was observed under an interference microscope, a somewhat disorderly interference fringe was seen.

When 500 kg of said undrawn yarn was drawn by hot rollers at a speed of 600 m/min and 1 kg pirns, the ratio of the perfectly formed packages was 90.5% without yarn breakage and filament breakage.

The following is claimed:

1. In a process for producing a highly oriented polyester undrawn yarn, in which said yarn is spun from a spinneret to a first take-up, the steps which comprise:

melt-spinning a polyester from a spinneret, solidifying the melt-spun yarn and taking up the solidified yarn at a take-up velocity from about 2,500 to 4,500 m/min, wherein the spinning length defined by the distance from said spinneret to said first take-up is within the range from about $(d + 2)/4$ (in meters) to about $(A/1.2)/(Faero/x)$ (in meters), wherein $d$ is the filament denier of the undrawn yarn, A is the tension (in grams) of the filament in an elongation range under constant tension of a stress-strain curve, $Faero/x$ is the rate of increase of the yarn tension per meter following the yarn solidification point by an air resistance which is equal to $0.229 \times 10^{-4} \cdot D^{0.39} \cdot V^{1.39}$, wherein D is the solidified filament diameter (in cm) and $V$ is the velocity of the solidified filament (in cm/sec), wherein the filament denier of the undrawn yarn is within the range from about 2 to 6.

2. A process according to claim 1, wherein the spinning length is within the range from about $(d + 2)/4$ (meter) to about $(A/1.4)/(Faero/x)$ (meter).

3. In a process for producing a highly oriented polyester undrawn yarn having a filament denier of about 2 to 6, in which said yarn is spun from a spinneret to a first take-up roller, the steps which comprise melt-spinning a polyester from a spinneret, solidifying the melt-spun yarn, passing the solidified yarn through a guide arranged to cause the yarn to bend through an angle of at least about 5°, and taking up the solidified yarn at a take-up velocity from about 2,500 to 4,500 m/min, wherein the spinning length defined by the distance from said spinneret to said first take-up roller is within the range from about $(d + 2)/4$ (in meters) to the lower value of either $(A/1.2)/(Faero/x)$ (in meters) or $B/(Faero/x)$ in meters), wherein $d$ is the filament denier of the undrawn yarn, $A$ is the tension (in grams) of the filament in the elongation range under a constant tension of a stress-strain curve, $B$ is the maximum allowable tension (in grams) of the undrawn filament when a maximum allowable tension at said guide is 0.3 g/d, and $Faero/x$ is the rate of increase of yarn tension per meter following the yarn solidifying point by an air resistance which is equal to $0.229 \times 10^{-4} \cdot D^{0.39} \cdot V^{1.39}$, wherein $D$ is the diameter of the solidified filament (in cm) and $V$ is the velocity of the solidified filament (in cm/sec).

* * * * *